US006350973B2

(12) United States Patent
Wroe et al.

(10) Patent No.: US 6,350,973 B2
(45) Date of Patent: Feb. 26, 2002

(54) RADIO-FREQUENCY AND MICROWAVE-ASSISTED PROCESSING OF MATERIALS

(75) Inventors: Fiona Catherine Ruth Wroe; Andrew Terence Rowley, both of Cheshire (GB)

(73) Assignee: EA Technology Limited, Chester (GB)

( * ) Notice: Subject to any disclaimer, the term of this patent is extended or adjusted under 35 U.S.C. 154(b) by 0 days.

(21) Appl. No.: 09/230,304

(22) PCT Filed: Jul. 24, 1997

(86) PCT No.: PCT/GB97/01984

§ 371 Date: May 11, 1999

§ 102(e) Date: May 11, 1999

(87) PCT Pub. No.: WO98/05186

PCT Pub. Date: Feb. 5, 1998

(30) Foreign Application Priority Data

Jul. 25, 1996 (GB) ..... 9615680

(51) Int. Cl.[7] ..... H05B 6/80; H05B 6/62

(52) U.S. Cl. ..... 219/680; 219/601; 219/702; 219/716; 219/778; 219/770; 373/144

(58) Field of Search ..... 219/601, 679, 219/680, 702, 716, 715, 718, 770, 776, 778; 373/144

(56) References Cited

U.S. PATENT DOCUMENTS

| | | | | |
|---|---|---|---|---|
| 2,602,134 A | * | 7/1952 | Nelson | 219/725 |
| 2,895,828 A | * | 7/1959 | Kamide | 219/718 |
| 4,002,875 A | * | 1/1977 | Kiuchi et al. | 219/680 |
| 4,687,895 A | * | 8/1987 | Chitre et al. | 219/388 |
| 4,880,578 A | | 11/1989 | Holcombe et al. | 264/26 |
| 4,963,709 A | | 10/1990 | Kimrey, Jr. | 219/10.55 |
| 5,177,333 A | * | 1/1993 | Ogasawara | 219/680 |
| 5,266,762 A | | 11/1993 | Hoffman et al. | 219/10.55 |
| 5,304,701 A | * | 4/1994 | Igarashi | 373/35 |
| 5,487,873 A | * | 1/1996 | Bridges et al. | 219/679 |

FOREIGN PATENT DOCUMENTS

| | | |
|---|---|---|
| EP | 066 632 | * 12/1982 |
| JP | 61-10744 | * 1/1986 |
| JP | 61-272524 | * 12/1986 |
| JP | 6-96856 | * 4/1994 |
| WO | WO 88/04127 | 6/1988 |
| WO | WO 91/08177 | 6/1991 |
| WO | WO 92/02150 | 2/1992 |
| WO | WO 94/20209 | 9/1994 |
| WO | WO 95/05058 | * 2/1995 |

* cited by examiner

*Primary Examiner*—Philip H. Leung
(74) *Attorney, Agent, or Firm*—Westman, Champlin & Kelly, P.A.

(57) ABSTRACT

There is described a hybrid furnace comprising a microwave source, and an enclosure for the confinement of both microwave and RF energy for containing an object to be heated. The microwave source is coupled to the enclosure. The furnace further includes an RF source coupled to the enclosure, and a controller for controlling the quantity of microwave energy and RF energy to which the object to be heated is exposed. There is also described a method of operating a furnace of the above type to the heat an object. The microwave source is actuated to induce an electric field to heat the object and the RF source is controlled to selectively provide an oscillating electric field within the object to be heated at a location at a temperature where the field strength of the microwave-induced electric field falls below a predetermined threshold value.

14 Claims, 7 Drawing Sheets

RADIO-FREQUENCY AND MICROWAVE-ASSISTED PROCESSING OF MATERIALS

This application is a national stage filing under 35 U.S.C. § 371 and priority is hereby claimed on International Application No. PCT/GB97/01984, filed Jul. 24, 1997, which International Application was published in English as No. WO 98/05186.

The present invention relates to the radio-frequency and microwave-assisted processing of materials, and in particular, but not exclusively, to the radio-frequency and microwave-assisted heating of ceramics, ceramic-metal composites, metal powder components, and engineering ceramics. To that end there is described a radio-frequency and microwave assisted furnace and a method of operating the same.

A hybrid furnace which combined conventional radiant and/or convective heating with microwave dielectric heating was described in the applicant's International Patent Application No. PCT/GB94/01730 which was published under International Publication No. WO 95/05058 on Feb. 16, 1995. In addition the International application also described in detail the problems associated with the conventional firing of ceramics and glass, the problems associated with the microwave only firing of ceramics and glass and the various interactions that take place between microwaves and materials. For this reason, and in order to avoid any undue repetition, the contents of International Patent Application No. PCT/GB94/01730 are incorporated herein by reference and is to be read alongside the present specification.

Conventional radiant or convective heating heats the surface of a sample and relies on thermal conduction to transfer heat from the surface throughout the volume of the sample. If a sample is heated too quickly, temperature gradients are produced which can lead to thermal stress and, ultimately, to the failure of the material. As the size of the sample is increased, this effect becomes exaggerated and, generally, samples have to be heated more slowly as their dimensions are increased.

The presence of temperature gradients also means that the whole of the sample cannot be processed using the same temperature-time schedule. This in turn often leads to variations in microstructure (eg grain size) throughout the sample, and, since not all parts of the sample can be processed to the optimum extent, poorer overall properties such as density, strength etc.

By contrast, careful balancing of conventional surface heating and microwave heating (ie volumetric heating) can ensure that the whole sample is heated uniformly without giving rise to temperature gradients and so leading to the possibility of much more rapid heating (particularly where large samples are concerned) without the risk of thermal stresses developing. Furthermore, since the whole sample can be processed to an optimum temperature—time schedule, it is possible to produce a highly homogeneous microstructure of increased density and increased material strength. It was this method of controlling the relative quantities of surface and volumetric heating that formed the subject of the applicant's earlier International Patent Application No. PCT/GB94/01730.

In addition to the thermal benefits produced by the volumetric nature of microwave heating, there is also increasing evidence to support the presence of a so-called non-thermal microwave effect during sintering. This is an effect which would not be observed even if conventional heat could somehow be introduced to the sample in the same volumetric way as microwave energy. Samples processed within a microwave furnace are observed to sinter at a faster rate or at a lower temperature than those processed in a conventional system. For example, Wilson and Kunz described in J.Am. Ceram. Soc 71(1) (1988) 40–41 how partially stabilised zirconia (with 3 mol % yttria) could be rapidly sintered using 2.45 GHz microwaves with no significant difference in the final grain size. The sintering time was reduced from 2 hours to about 10 minutes. This has been explained with reference to an effective activation energy for the diffusion processes taking place during sintering so that, for example, Janney and Kimrey describe in Mat. Res. Symp. Proc. Vol. 189 (1991), Materials Research Society that at 28 GHz, the microwave enhanced densification of high purity alumina proceeds as if the activation energy is reduced from 575 kJ/mol to 160 kJ/mol.

Despite the potential implications for the ceramics industry the physical mechanisms which give rise to this effect are not understood. The microwaves must interact with the ceramic so as to either reduce the actual activation energy or increase the effective driving force experienced by the diffusing species. Both possible mechanisms have their supporters but the present applicant favours the existence of an enhancement to the driving force. This at least is consistent with the calculations of Rybakov and Semenov who showed in Phys. Rev. B.49(1) (1994) 64–68 that the driving forces for vacancy motion can be enhanced near a surface or boundary in the presence of a high frequency electric field.

The power density, $P_v$, dissipated within a sample heated by a microwave field is given by $$P_v = 2\pi f \epsilon_o \epsilon_r'' E^2 \tag{1}$$

where f is the frequency of the applied field, $\epsilon_o$ is the permittivity of free space, $\epsilon_r''$ is the dielectric loss factor of the material, and E is the electric field strength. Rearranging this equation the electric field is given by $$E = \sqrt{\frac{P_v}{2\pi f \varepsilon_o \varepsilon_r''}} \tag{2}$$

Unfortunately, the dielectric loss factors of many low loss ceramic materials such as alumina, zirconia etc increase almost exponentially with increasing temperature. Assuming that the power density required for heating remains constant during the process, equation (2) implies that the electric field strength in the material must fall away rapidly with increasing temperature. Consequently, the magnitude of any non-thermal effects due to the presence of the electrical field will also be reduced at higher temperatures just when the diffusing species are most free to move through the material since the diffusion coefficient increases exponentially with increasing temperature.

Similarly, the depth of penetration (ie the distance in which the power density falls to 1/e of its value at the surface) for electromagnetic waves such as microwaves propagating in a dielectric material is given by $$d_p = \frac{c}{2\pi f \sqrt{2}\, \varepsilon_r'} \left[ \sqrt{1 + \left(\frac{\varepsilon_r''}{\varepsilon_r'}\right)^2} - 1 \right]^{\frac{1}{2}} \tag{3}$$

where $\epsilon_r'$ is the dielectric constant of the material and c is the speed of light in a vacuum. If one were to consider yttria stabilised zirconia (8%YSZ), at low temperatures (ie at approximately 200° C.) and at 2.45 GHz, a standard microwave frequency, the dielectric constant, $\epsilon_r'$, is approximately 20 and the dielectric loss factor, $\epsilon_r''$, is about 0.2. Inserting these values into equation (3) gives a penetration depth of 45 cm. At higher temperatures of approximately 1,000° C., $\epsilon_r'$ is approximately 34 and $\epsilon_r''$ is approximately 40, giving a penetration depth of only 0.3 cm. Thus at high temperatures microwaves of 2.45 GHz are not particularly effective at heating samples of yttria stabilised zirconia of more than about 1 cm thick, although this is still much better than conventional methods of heating where only the immediate surface is heated. Again, however, any non-thermal microwave effect will also be limited to the penetration depth.

In order to overcome these problems whilst making the optimum use of any non-thermal effect, according to a first aspect of the present invention there is provided a hybrid furnace comprising a microwave source, an enclosure for the confinement of both microwave and RF energy and for containing an object to be heated, means for coupling the microwave source to said enclosure, an RF source, means for coupling the RF source to said enclosure, and control means for controlling the quantity of microwave energy and RF energy to which the object to be heated is exposed.

Advantageously, the hybrid furnace may additionally comprise radiant and/or convective heating means disposed in relation to the enclosure to provide radiant and/or convective heat as appropriate within the enclosure and means for controlling the quantity of heat generated in the object by the radiant and/or convective heat.

According to a second aspect of the present invention there is provided a method of operating a furnace of the type comprising a microwave source, an enclosure for the confinement of both microwave and RF energy and for containing an object to be heated, means for coupling the microwave source to said enclosure, an RF source, and means for coupling the RF source to said enclosure, the method comprising the steps of actuating the microwave source to heat the object and actuating the RF source to provide an oscillating electric field within the object to be heated at a location and/or at a temperature where the field strength of the microwave-induced electric field falls below a predetermined threshold value.

Advantageously, the furnace may additionally comprise radiant and/or convective heating means and the method may then comprise the additional steps of actuating the radiant and/or convective heating means so as to generate radiant and/or convective heat substantially throughout the heating cycle of the object and controlling the quantity of heat generated in the object by one or both of the microwave energy and the radiant and/or convective heat so as to provide a desired thermal profile in the object.

Radio-frequency (RF) is another form of dielectric heating involving a high frequency electric field and is also described by equations (1) to (3). However, radio-frequencies are much lower than those of microwaves—typically 13.56 MHz (ie a factor of 181 times less than 2.45 GHz). Thus, for the same values of $\epsilon_r''$ and $P_v$, equation (2) suggests that the electric field will be 13 times higher for the RF case than for the microwave case. Indeed, the dielectric loss factors of ceramics at radio-frequencies are usually much smaller than at microwave frequencies so that in fact the electric field will be even higher.

Likewise, an inspection of equation (3) reveals that the penetration depth is proportional to 1/f. Consequently, assuming that all other parameters are the same, $d_p$ will be 181 times larger in the RF case than in the microwave case and the resulting electric field will penetrate deep within the material even at very high temperatures.

Unfortunately, many ceramic materials are not heated effectively when they are placed solely in an RF electric field. The required electric field to give reasonable energy dissipation at this frequency is often in excess of that which would cause electrical breakdown in the furnace. However, by providing a hybrid system which uses both microwave and RF volumetric heating this problem can be overcome. When combined with conventional surface heating techniques even greater benefits may be obtained.

A number of embodiments of the present invention will now be described by way of example with reference to the accompanying drawings in which.

The term dielectric heating is equally applicable to radio-frequency or microwave systems and in both cases the heating is due to the fact that a dielectric insulator (or a material with a small, but finite, electrical conductivity) absorbs energy when it is placed in a high frequency electric field.

RF and microwave radiation occupy adjacent sections of the electromagnetic spectrum, with microwaves having higher frequencies than radio waves. However, the distinction between the two frequency bands is often blurred with, for example, some applications such as cellular telephones at around 900 MHz being described as radio frequency and some, such as dielectric heating, being described as microwaves. Nevertheless, radio frequency and microwave dielectric heating can be distinguished by the technology that is used to produce the required high frequency electric fields. RF heating systems use high power electrical valves, transmission lines, and applicators in the form of capacitors whereas microwave systems are based on magnetrons, waveguides and resonant or non-resonant cavities.

There are internationally agreed and recognised frequency bands which can be used for RF and microwave heating known as ISM bands or Industrial, Scientific and Medical Bands. At radio frequencies these are (i) 13.56 MHz±0.05% (±0.00678 MHz)

(ii) 27.12 MHz±0.6% (±0.1627 MHz)

(iii) 40.68 MHz±0.05% (±0.02034 MHz)

while at microwave frequencies they are (i) −900 MHz (depending on the country concerned)

(ii) 2450 MHz±50 MHz

Electromagnetic compatibility (EMC) requirements impose severe limits on any emissions outside these bands. These limits are much lower than those imposed by health and safety considerations and are typically equivalent to $\mu$Ws of power at any frequency outside the allowed bands. In most countries compliance with the relevant EMC regulations is a legal requirement.

Figure 1:
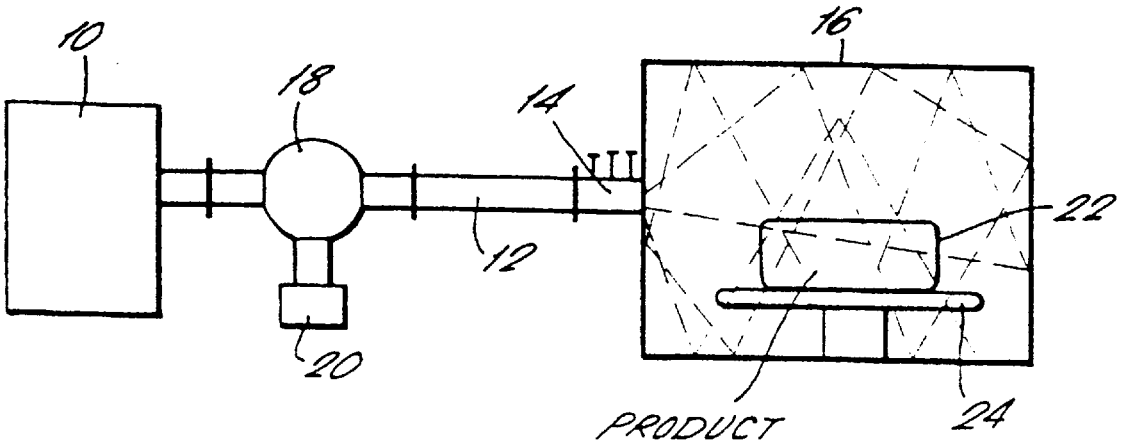
FIG. 1 is a schematic view of a typical microwave heating system of the prior art.

Microwave heating systems and microwave heating systems in combination with conventional radiant and/or convective heating systems have been described in detail in the applicant's International Patent Application No. PCT/GB94/01730, the contents of which has already been incorporated herein by reference. As a result microwave heating systems will only be described here in summary so as to allow a comparison with RF heating systems. As shown in FIG. 1, microwave heating systems generally consist of a high frequency power source 10, a power transmission medium 12, a tuning system 14 and an applicator 16. The high frequency power source commonly used in microwave heating systems is a magnetron. At 2.45 MHz, magnetrons are available with power outputs of typically between 500 W and 2 kW and can reach a maximum of 6–10 kW. At 900 MHz, magnetrons can be constructed with higher power outputs of up to 10 s of kW. By contrast, the single valves used in RF heating systems can produce 100 s of kW. The power produced by a magnetron is approximately independent of the state of the load.

The magnetron excites an antenna or an aperture radiator which then transfers the power to the rest of the system. The antenna generates electromagnetic waves which travel down wave-guides which act as the power transmission medium 12 and which are used to direct the waves to the microwave applicator 16. In some applications, the wave-guides themselves can form the applicator.

The reflection of substantial power from the applicator 16 to the high frequency power source 10 can cause damage and, in order to prevent this, a device known as a circulator 18 is inserted between the power source and the transmission medium 12. The circulator 18 is basically a one-way valve which allows power from the power source 10 to reach the applicator 16 but stops any reflected power reaching the power source. Instead the reflected power is dissipated in a water load 20 attached to the circulator 18.

The tuning system 14 is inserted between the power transmission medium 12 and the applicator 16 and is used to tune to a minimum any reflected power thereby ensuring that the system operates with high efficiency.

The most common form of microwave applicator 16 is a metal box or cavity such as that used in a domestic microwave oven. The material to be heated 22 is placed within this cavity on a turntable 24 which is used to average out over time any variations in the electric field that might exist within the material concerned. In addition, a mode stirrer (not shown) is also often incorporated within the cavity so as to periodically change the standing wave patterns which exist within it. Both the turntable 24 and the mode stirrer improve the uniformity of the heating of the material.

As well as the cavity applicator, there are many other designs of microwave applicator 16 which can be used. However, of these, the ones which are most commonly used as applicators are modified waveguide sections.

In appearance, RF heating systems are very different to microwave systems. The available systems for producing and transferring RF power to dielectric heating applicators can be divided into two distinct groupings; the more widespread conventional RF heating equipment, and the more recent 50Ω RF heating equipment. Although conventional RF equipment has been used successfully for many years, the ever tightening EMC regulations, and the need for improved process control, is leading to the introduction of RF heating systems based on 50Ω technology.

In a conventional system, the RF applicator (ie the system which applies the high frequency field to the product) forms part of the secondary circuit of a transformer which has the output circuit of the RF generator as its primary circuit. Consequently, the RF applicator can be considered to be part of the RF generator circuit, and is often used to control the amount of RF power supplied by the generator. In many systems, a component of the applicator circuit (usually the RF applicator plates themselves) is adjusted to keep the power within set limits. Alternatively, the heating system is set up to deliver a certain amount of power into a standard load of known conditions and then allowed to drift automatically up or down as the condition of the product changes. In virtually all conventional systems, the amount of RF power being delivered is only indicated by the DC current flowing through the high power valve, usually a triode, within the generator.

Figure 2:
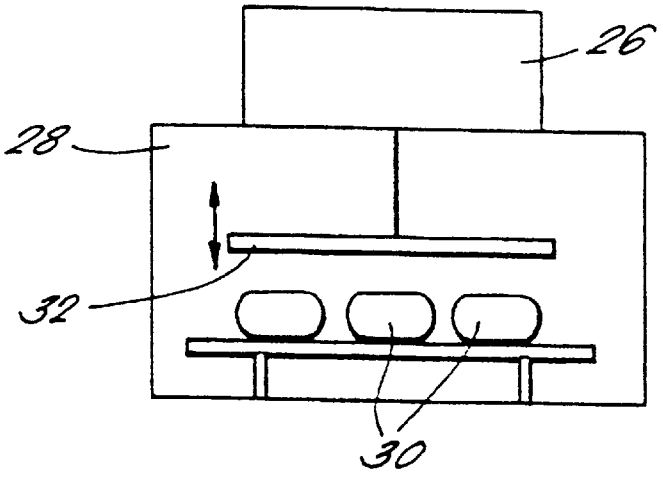
FIG. 2 is a schematic view of a conventional RF heating system of the prior art.

A typical conventional RF heating system is shown schematically in FIG. 2 to comprise an RF generator 26 and an RF applicator 28. The material to be heated 30 is placed between the plates of the RF applicator 28 and one of the plates 32 is adapted so as to be moveable with respect to the other so as to provide a means for tuning the system.

Figure 3:
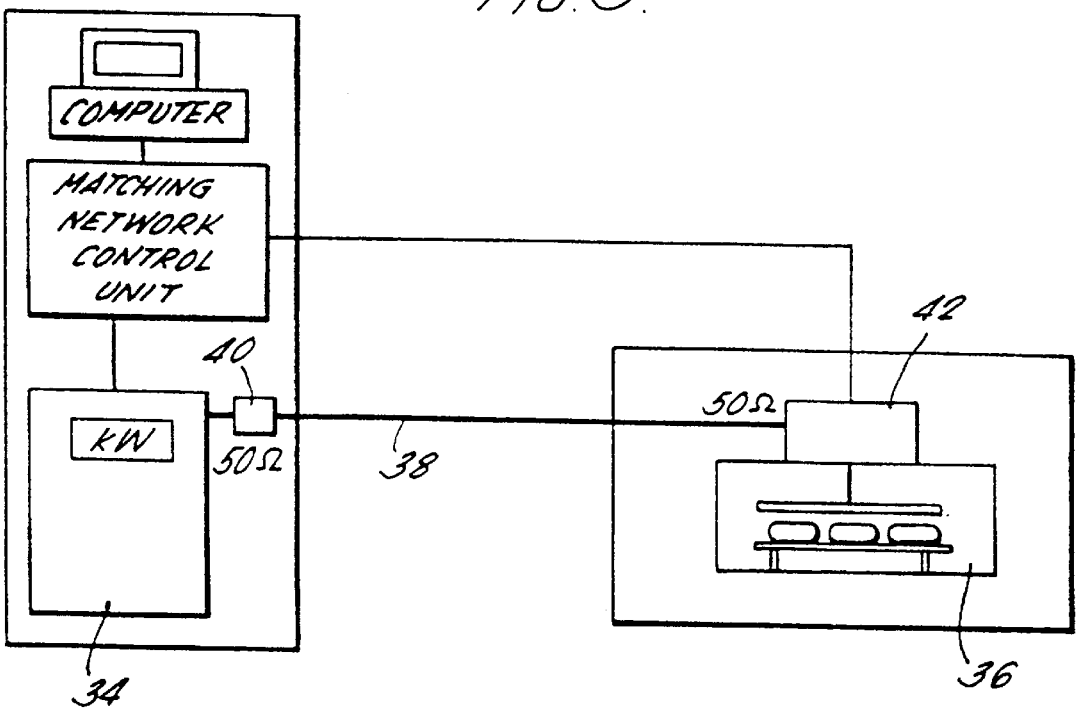
FIG. 3 is a schematic view of a typical 50Ω RF heating system of the prior art.

RF heating systems based on 50Ω equipment are significantly different and are immediately recognisable by the fact that the RF generator is physically separated from the RF applicator by a high power coaxial cable. One such example is shown in FIG. 3 and, as before, comprises an RF generator 34 and an RF applicator 16. The high power coaxial cable is identified by reference numeral 38.

The operation frequency of a 50Ω RF generator is controlled by a crystal oscillator and is essentially fixed at 13.56 MHz or 27.12 MHz (40.68 MHz being seldom used). Once the frequency has been fixed, it is relatively straightforward to set the output impedance of the RF generator 34 to a convenient value. 50Ω is chosen so that standard equipment such as high power coaxial cable 38 and RF power meter 40 can be used. For the RF generator 34 to transfer power efficiently, it must be connected to a load which also has an impedance of 50Ω. Consequently, an impedance matching network 42 is included in the system which transforms the impedance of the RF applicator 36 to 50Ω. In effect, this matching network 42 is a sophisticated tuning system and the RF applicator plates themselves can be fixed at an optimum position.

The main advantages of this technology over the conventional system are:

(i) Fixed operation frequency makes it easier to meet onerous international EMC regulations.

(ii) The use of 50Ω cable allows the RF 34 generator to be sited at a convenient location away from the RF applicator 36.

(iii) The RF applicator 36 can be designed for optimum performance and is not itself part of any tuning system.

(iv) The use of an impedance matching network 42 gives the possibility of an advanced process control system. The positions of components in the matching network give on-line information on the condition of the dielectric load such as its average moisture content. This information can then be used to control, as appropriate, the RF power, the speed of a conveyor, the temperature of the air in the applicator etc.

Figure 4:
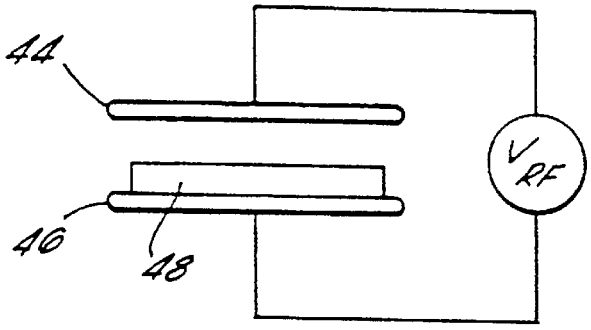
FIG. 4 is a schematic view of a simple through-field applicator.

Whether conventional or 50Ω dielectric heating systems are used, the RF applicator has to be designed for the particular product to be heated or dried. Conceptually, a through-field RF applicator is the simplest, and the most common, design with the electric field originating from a high frequency voltage applied across the two electrodes of a parallel plate capacitor. An example of this arrangement is shown in FIG. 4 in which the two electrodes are identified by reference numerals 44 and 46 and the product to be heated is identified by reference numerals 48. This type of applicator is mainly used with relatively thick products or blocks of material and is the applicator that is used in the embodiments to be described.

Dielectric heating, whether it be RF or microwave, relies on the principle that energy is absorbed by a dielectric material when it is placed in a high frequency electric field. Calculation of the actual amount of energy (or power) absorbed by a dielectric body is essential to a full understanding of RF and microwave heating and/or drying.

In essence, all applicators used for RF dielectric heating are capacitors. These capacitors can be represented by a complex electrical impedance, $Z_c$, or the equivalent complex electrical admittance, $Y_c$ equal to $1/Z_c$. When empty, an ideal capacitor has an impedance which is purely reactive with zero electrical resistance and no power is dissipated when an RF potential is applied across it. In the absence of a dielectric, the complex impedance of the applicator is given by $$Z_c = 0 - \frac{j}{\omega C_o} \tag{4}$$

with the equivalent admittance given by $$Y_c = 0 + j\omega C_o \tag{5}$$

where $\omega = 2\pi f$ and $C_o$ is the capacitance of the empty applicator.

The relative permittivity of a dielectric, $\epsilon_r$, sometimes called the complex dielectric constant is given by $$\epsilon_r = \epsilon_r' - \epsilon_r'' j \tag{6}$$

where $\epsilon_r'$ is a dielectric constant and $\epsilon_r''$ is the dielectric loss factor of the material. If a simple parallel plate capacitor is filled with such a dielectric, then the new admittance is given by $$Y_c' = \epsilon_r Y_c = \omega C_o \epsilon_r'' + j\omega C_o \epsilon_r' \tag{7}$$

and the corresponding new impedance equal to $1/Y_c'$ is then $$Z_c' = \frac{1}{\omega C_o}\left(\frac{\varepsilon_r'' - j\varepsilon_r'}{\varepsilon_r''^2 + \varepsilon_r'^2}\right) \tag{8}$$

Figure 5:
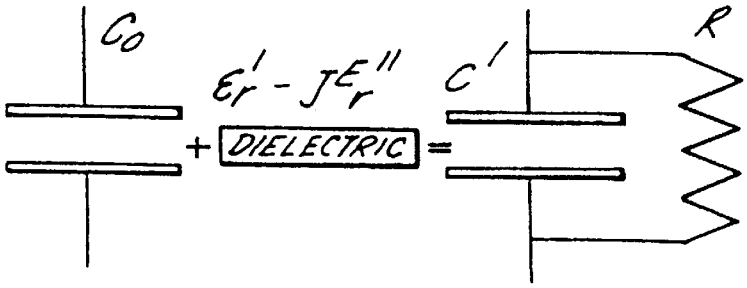
FIG. 5 is a schematic view illustrating the effect of a dielectric on a capacitor.

As is clear from equation (8), the presence of the dielectric alters the impedance of the RF applicator in two ways. First, a finite resistance, R equal to $1/(\omega C_o \epsilon_r'')$ has appeared across the capacitor and secondly, the new effective capacitance, C', is greater than the capacitance without the dielectric, $C_o$, by a factor of $\epsilon_r'$ since by definition $\epsilon_r'$ is always greater than one. This situation is shown schematically in FIG. 5. The increase in capacitance arises from changes in the distribution of electric charge within the RF applicator while the presence of a finite resistance gives rise to the possibility of heat generation within the dielectric. Taking the power, P, dissipated in a resistance to be equal to $V^2/R$, then for a capacitor containing a dielectric $$P = \omega \epsilon_r'' C_o V^2 \tag{9}$$

For a parallel plate capacitor where $C_o = \epsilon_o A/d$ and where A is the plate area, d is the plate separation and $\epsilon_o$ is the permittivity of free space, since the electric field strength, E=V/d, equation (9) can be rewritten as $$P = \omega \epsilon_o \epsilon_r'' E^2 (Ad) \tag{10}$$

Since the product Ad is equal to the volume of the capacitor, the power dissipation per unit volume or power density, $P_v$, is given by $$P_v = \omega \epsilon_o \epsilon_r'' E^2 = 2\pi f \epsilon_o \epsilon_r'' E^2 \tag{11}$$

Thus the power density is proportional to the frequency of the applied electric field and the dielectric loss factor, and is proportional to the square of the local electric field. This equation is crucial in determining how a dielectric will absorb energy when it is placed in a high frequency electric field. For a given system, the frequency is fixed and π and $\epsilon_o$ are constants and the dielectric loss factor of $\epsilon_r''$ can, in principle, be measured. The only unknown left in equation (11) therefore is the electric field, E. To evaluate this, the effect of the dielectric on the applied electric field due to the RF voltage across the RF applicator must be considered.

In the case of microwave dielectric heating, the applicator can no longer be considered to be a simple capacitor and the electric field in the material is now that due to a propagating electromagnetic wave of the form $$E = E_o e^{j(wt - kz)} \tag{12}$$

where k is the propagation constant in the z direction and t is the time.

The displacement current density, $J_D$, flowing through the dielectric media is defined by $$J_D = \varepsilon_o \varepsilon_r \frac{\partial E}{\partial t} \tag{13}$$

which, in combination with equation (12), becomes $$J_D = j\omega \epsilon_o \epsilon_r E \tag{14}$$

substituting $\epsilon_r = \epsilon_r' - j\epsilon_r''$ gives $$J_D = \omega \epsilon_o \epsilon_r'' E + j\omega \epsilon_o \epsilon_r' E \tag{15}$$

If J is the total current density and equals the sum of the conduction current density, $J_C$, and the displacement current density, $J_D$, and assuming $J_C$ to be zero, then J will equal $J_D$ and be given by the expression in equation (15).

Considering a small volume element of the dielectric, dV of cross section, dS and length dz, the voltage drop across the volume element is given by E.dz and the current passing through it is given by J.ds. As a result the power dissipated per unit volume is given by $$\frac{dP}{dV} = (E.\ J) \tag{16}$$

where (..) represents the time average.

If $\epsilon_r$ is real (ie $\epsilon_r''$ is equal to zero) then E and J will always be $\pi/2$ out of phase and dP/dV will be equal to zero at all times. If $\epsilon_r''$ is not equal to zero, then $$\frac{dP}{dV} = \frac{1}{2}\omega\varepsilon_o\varepsilon_r'' E * E \tag{17}$$

where E* is the complex conjugate of E. In the special case where E can be assumed to be constant throughout the product equation (17) reduces to $$P_v = \omega\epsilon_o\epsilon_r'' E_{rms}^2 = 2\pi f\epsilon_o\epsilon_r'' E_{rms}^2 \tag{18}$$

which is the same as that derived for the RF dielectric heating case (equation 11).

A dielectric material consists of an assembly of a large number of microscopic electric dipoles which can be aligned, or polarised, by the action of an electric field. For an evaluation of the interaction of a dielectric with an external field, it is necessary to understand the effect of this polarisation.

An electric dipole is a region of positive charge, +q, separated from a region of negative charge, −q, by a small distance r. Such a dipole is said to have a dipole manner, p given by $$p = qr \tag{19}$$

This dipole moment is a vector quantity with direction along the line from the positive to the negative charge centre. Electric dipoles can be divided into two types (i) Induced dipoles which only appear in the presence of an applied electric field, such as carbon dioxide molecules and atoms; and (ii) Permanent dipoles which are present even in the absence of an applied electric field, such as water molecules.

The polarisation of a material, P, is a macroscopic property and is defined as the dipole moment per unit volume. In the absence of an electric field, the dipole moment of an assembly of induced dipoles is zero and, consequently, P is also zero. Although permanent electric dipoles always possess a dipole moment, in the absence of an applied field these moments are randomly oriented in space and the polarisation of the material as a whole, P, is again equal to zero.

A macroscopic polarisation is also possible due to space charge build up at boundaries within the material. Any such separation of negative and positive charges leads to a dipole moment for the whole material, sometimes known as the interfacial polarisation.

It is principally the polarisation of a dielectric that determines the electric field inside (and outside) the material and with it the heating rate since, as equations (11) and (18) make clear, the absorbed power density is proportional to the square of the electric field inside the material.

Given the presence of an external electric field, $E_o$, the microscopic electric dipoles will experience a torque which tends to line them up in a direction opposite to that of $E_o$. The negative end of the dipole is attracted to the positive side of the applied field and the positive end of the dipole is attracted to the negative side of the applied field.

Figure 6:
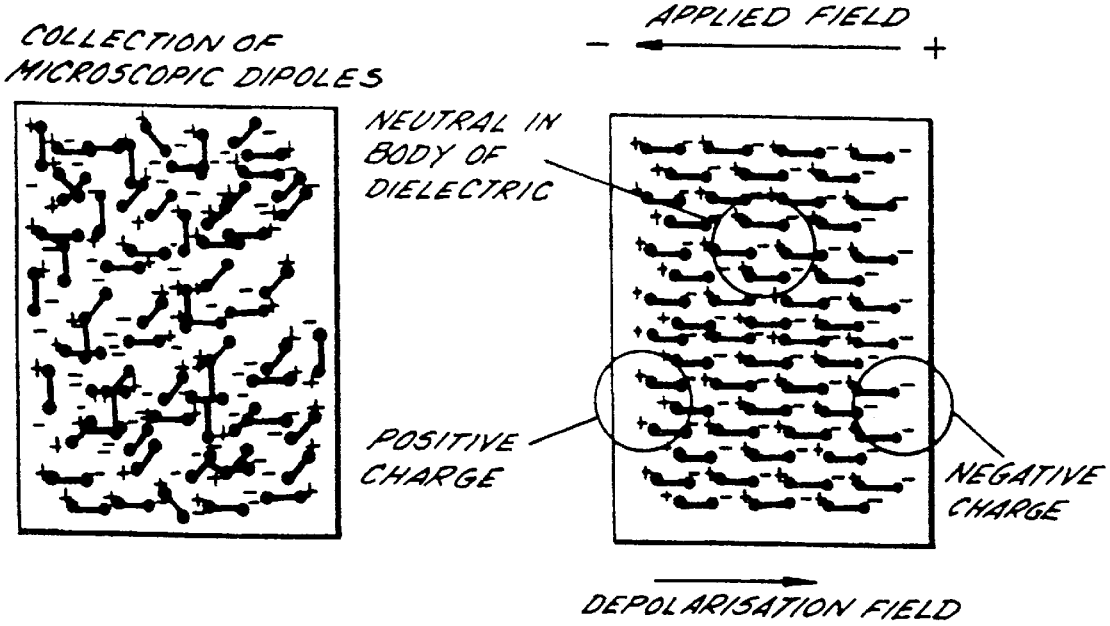
FIG. 6 is a schematic view of a dielectric made up of a collection of microscopic dipoles before and after the application of an electric field.

Within the main body of the dielectric, the total electric charge is neutral because the number of positive charges equals the number of negative charges. However, at one side of the dielectric there is a net excess of positive charges while at the other side there is a net negative charge. This is the situation illustrated schematically in FIG. 6.

Thus the result of applying an electric field, $E_o$, to a dielectric is the development of positive and negative charges on opposite sides of the material. The electric field due to these charges is in the opposite direction to the applied field, and is called the depolarising field, $E_1$. An electric dipole within the body of the dielectric experiences a local field, $E_{local}$, which is the vector sum of the applied and depolarising fields. Thus, $$E_{local} = E_o + E_1 \tag{20}$$

and has a magnitude given by $$|E_{local}| = |E_0| - |E_1| \tag{21}$$

Figure 7:
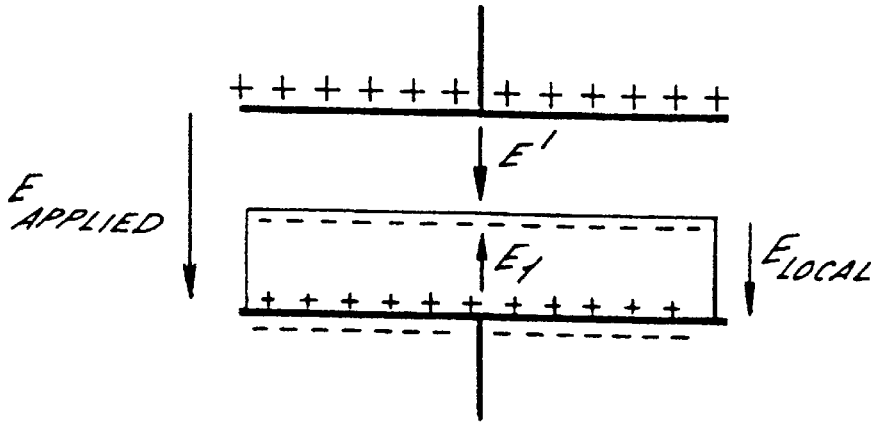
FIG. 7 is a schematic view of the electric fields within an RF applicator.

The effect of the dielectric on the electric field that exists within an RF applicator is shown schematically in FIG. 7. Whilst the local electric field is less than the applied electric field, the electric field in any air gaps surrounding the dielectric, E', is larger than the applied field. This is due to the development of charge on the surface of the dielectric. In fact, where the surrounding medium is air, E is approximately equal to $\epsilon_r' E_0$ and, since $\epsilon_r$ is always greater than one, E' is always greater than $E_0$.

Figure 8:
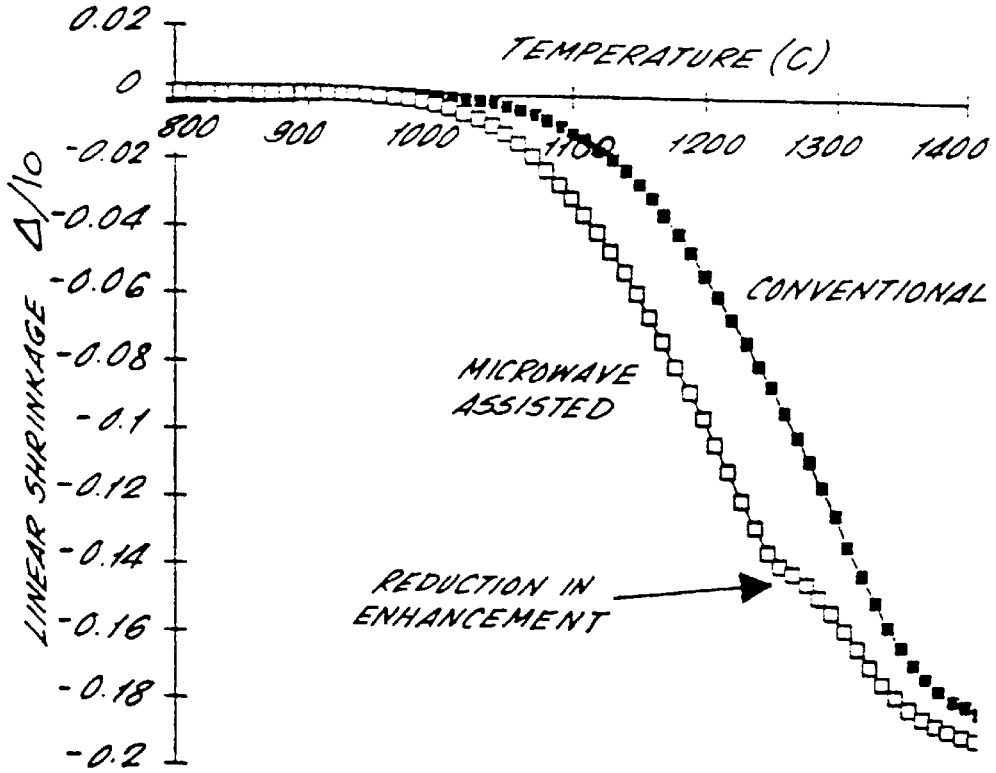
FIG. 8 is a graph illustrating the normalised linear shrinkage of zirconia (3 mol % yttria) plotted as a function of temperature for conventional (radiant heat only) and microwave-assisted sintering.

As was pointed out earlier in connection with equation (2), the electric field strength within many ceramic materials falls away rapidly with increasing temperature. Consequently, the magnitude of any non-thermal effects due to the electric field strength will also be reduced at these higher temperatures just when the diffusing species are most free to move within the material since the diffusion coefficient increases exponentially with increasing temperature. FIG. 8 shows the normalised linear shrinkage, $\Delta l/l_o$, plotted as a function of temperature, $l_o$ being the original sample length, for conventional sintering (ie using solely radiant and/or convective heat) and microwave-assisted sintering of partially stabilised zirconia (3 mol % yttria).

The enhancement of the sintering is clearly demonstrated in that the microwave-assisted curve is displaced by approximately 80° C. from the conventional shrinkage curve. Furthermore, the total shrinkage is greater in the microwave-assisted case leading to an increase in the final sample density. At about 1,250° C. there is a significant change in gradient in the microwave-assisted curve. Towards the end of the microwave-assisted sintering, although the applied microwave power is still approximately constant, the electric field will be falling due to the increase in the dielectric loss factor, $\epsilon_r''$. Consequently, the microwave-induced electric field driving the diffusion process will also be falling rapidly and the sintering will proceed dominated solely by the conventional, capillary driving force. Although the microwave power density increases as the sample shrinks, this effect on the electric field is much smaller than that due to the exponential increase in $\epsilon_r''$.

As was pointed out earlier in connection with equation (3), the decrease in penetration depth of microwaves at high temperatures will also have a detrimental effect on the ability of the microwave-induced electric field to drive the diffusion process, particularly for samples which are more than about 1 centimeter thick. However, by constructing a furnace which uses radio-frequency and microwave-assisted heating simultaneously, it is possible to enjoy the advantages of volumetric heating without any significant reduction in the diffusion process at higher temperatures. This is because, although the RF will not be as good at heating the sample as the microwaves, it will be able to generate and maintain a higher electric field within the sample, thereby aiding the diffusion process.

The practical problems to be overcome in combining RF and microwave sources together with radiant and/or convective heating means in the same furnace is not straightforward. The two high frequency heating sources will interact with each other and, unless care is taken, lead to operational difficulties. This is in addition to the problems of any interference of either source with the conventional radiant and/or convective heating means.

Figure 9:
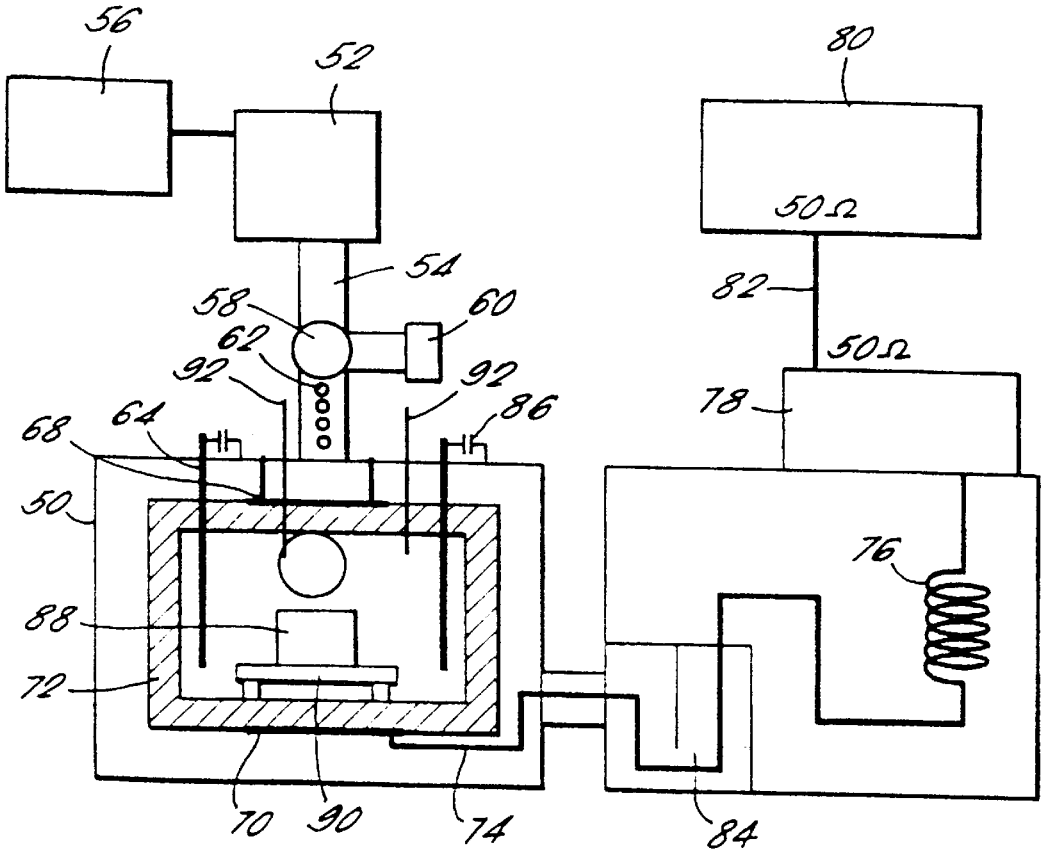
FIG. 9 is a schematic view of an RF and microwave-assisted hybrid furnace in accordance with a first embodiment of the present invention.

Nevertheless, an RF and microwave-assisted hybrid furnace embodying the present invention is shown schematically in FIG. 9.

As can be seen, the furnace comprises a microwave cavity 50, a microwave generator 52 and a waveguide 54 for transporting microwaves from the microwave generator 52 to the microwave cavity 50. In a preferred embodiment the microwave generator 52 may comprise a 2.45 GHz, 1 kW magnetron connected to a power supply unit 56, while the waveguide 54 may include a circulator 58, a dummy load 60 and a tuner 62. By contrast, in a preferred embodiment, the microwave cavity 50 has a width of 540 mm, a depth of 455 mm and a height of 480 mm. This in turn provides a sample volume of 190 mm×190 mm×190 mm which, in use, is closed by the shutting of a door incorporating a quarter-wave choke microwave seal. A mode stirrer (not shown) is incorporated within the microwave cavity 50 with a fail-safe mechanism for switching off the microwave power in the event of the mode stirrer failing.

A plurality of non-retractable, radiant kanthal resistance heating elements 64 project through a wall of the microwave cavity 50 and into the sample volume. By ensuring that the heating elements 64 are highly conductive their skin depth is kept to a minimum and with it the amount of microwave power that they absorb. Using this arrangement the furnace has been shown to be capable of achieving temperatures in excess of 1,750° C. using 3 kW of radiant heating and 2 kW of microwave power without damaging either the heating elements 64 or the lining of the furnace. In particular, no arcing has been observed either between the heating elements 64 or between the heating elements and the walls of the microwave cavity 50.

In order to prevent microwaves leaking from the microwave cavity 50, each of the heating elements 64 passes into the sample volume through a respective capacitive lead-through. An example of one such lead-through is described in the applicant's earlier International Patent Application No. PCT/GB94/01730, the contents of which has already been incorporated herein by reference.

The RF electric field is introduced into the system between the electrodes of a parallel plate capacitor or applicator formed by two metal plates 68 and 70 on the outside of the insulation 72. Alternatively, the two plates 68 and 70 can be embedded within the insulation 72 or even inside the hot zone provided that the metal used can withstand the temperatures to which it will be exposed. The two metal plates 68 and 70 are connected through a transmission line 74 and a variable inductance 76 to an automatic impedance matching network 78. This impedance matching network 78 constantly tunes the impedance of the system of 50Ω. A 13.56 MHz, 1 kW radio-frequency solid-state generator 80 with a 50Ω output impedance is connected to the automatic impedance matching network 78 by a standard 50Ω coaxial cable 82.

One section of the transmission line 74 between the two metal plates 68 and 70 and the variable inductance 76 includes a low pass filter 84 which acts as a microwave filter and allows the passage of RF power whilst restricting the flow of microwave energy. Additional parallel capacitors 86 are connected between the heating elements 64 and the top of the furnace cavity to short any RF current flowing through the heating elements to ground.

The sample to be heated 88 is placed within the microwave cavity and supported on a refractory stand 90. Earthed thermocouples 92 within the furnace can be used to control the radiant, RF and microwave power levels independently. Alternatively, all three power sources can be controlled manually. Typically, some combination of automatic and manual control is used. For example, the radiant and microwave power sources might be controlled to some predetermined temperature-time schedule while the RF power source is controlled manually. Once the material to be heated has been fully evaluated, the control may be fully automatic.

Figure 10:
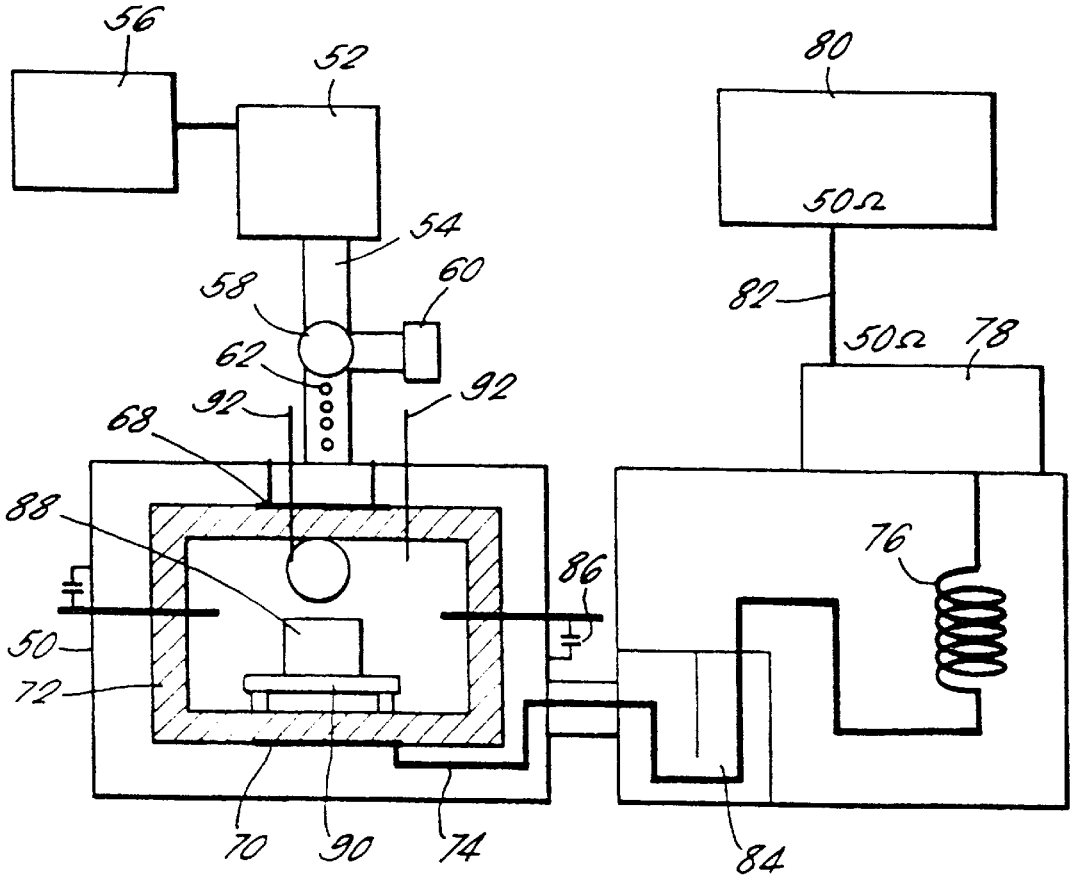
FIG. 10 is a schematic view of an RF and microwave-assisted hybrid furnace in accordance with a second embodiment of the present invention.

It will be apparent to those skilled in the art that the radiant heating elements 64 could be replaced by one or more gas burners 94 in either a direct or indirect configuration such as was described in the applicant's earlier International Patent Application No. PCT/GB94/01730, the contents of which has been incorporated herein by reference. An example of one such arrangement is shown in FIG. 10 where those features common to the furnace of FIG. 9 have been identified using the same reference numerals.

One advantage of using gas burners as a source of radiant and/or convective heat is that the resulting furnace is particularly suitable for either batch or continuous processing. Furthermore, the maximum temperature that can be obtained by such a furnace is limited only by the materials of its construction.

In either furnace, the ratio of conventional to microwave power is typically less than 2:1 and more usually in the range from 10:1 to 5:1. At the same time, the ratio of RF to microwave power is typically less than 2:1 and more usually in the range from 10:1 to 4:1.

Furnaces of the type described above have been used to sinter small pieces of yttria (8%) stabilised zirconia (8 YSZ). Samples of the precursor powders were cold die pressed to form cylindrical samples which were then heated using the schedule:

(i) Heating from room temperature to 1300° C. at 10° C./minute;

(ii) Hold at 1300° C. for 1 hour; and (iii) Cooling from 1300° C. to room temperature at −10° C./minute.

The radiant power level was used to control the temperature to this schedule, and various combinations of RF and microwave power were used. In each case, the final density of the sample was measured and compared with the starting density of approximately 2.85 $gcm^{-13}$. The results are summarised below in Table 1.

| Conventional | Microwave | Radio-Frequency | Final Density |
|---|---|---|---|
| Variable | None | None | 5.550 $gcm^{-3}$ |
| Variable | None | None | 5.553 $gcm^{-3}$ |
| Variable | None | 300 W | 5.587 $gcm^{-3}$ |
| Variable | 600 W | None | 5.609 $gcm^{-3}$ |
| Variable | 800 W | 450 W | 5.644 $gcm^{-3}$ |

A second series of experiments was carried out on larger pellets of the same material which had a slightly lower starting density of 2.67 $gcm^{-3}$. The results of this second series of experiments are summarised in Table 2 below.

| Conventional | Microwave | Radio-Frequency | Final Density |
|---|---|---|---|
| Variable | None | None | 5.291 $gcm^{-3}$ |
| Variable | None | 200 W | 5.430 $gcm^{-3}$ |
| Variabie | None | 400 W | 5.452 $gcm^{-3}$ |
| Variable | 800 W | 200 W | 5.514 $gcm^{-3}$ |

As can be seen, it is possible to conclude from these two series of experiments that for the sintering of yttria stabilised zirconia:

(i) The use of RF-assisted or microwave-assisted heating results in higher final densities than using only conventional radiant or convective heating;

(ii) The use of microwave-assisted heating results in higher densities than the use of RF-assisted heating; and (iii) The use of both RF and microwave-assisted heating results in the highest final densities.

Figure 11:
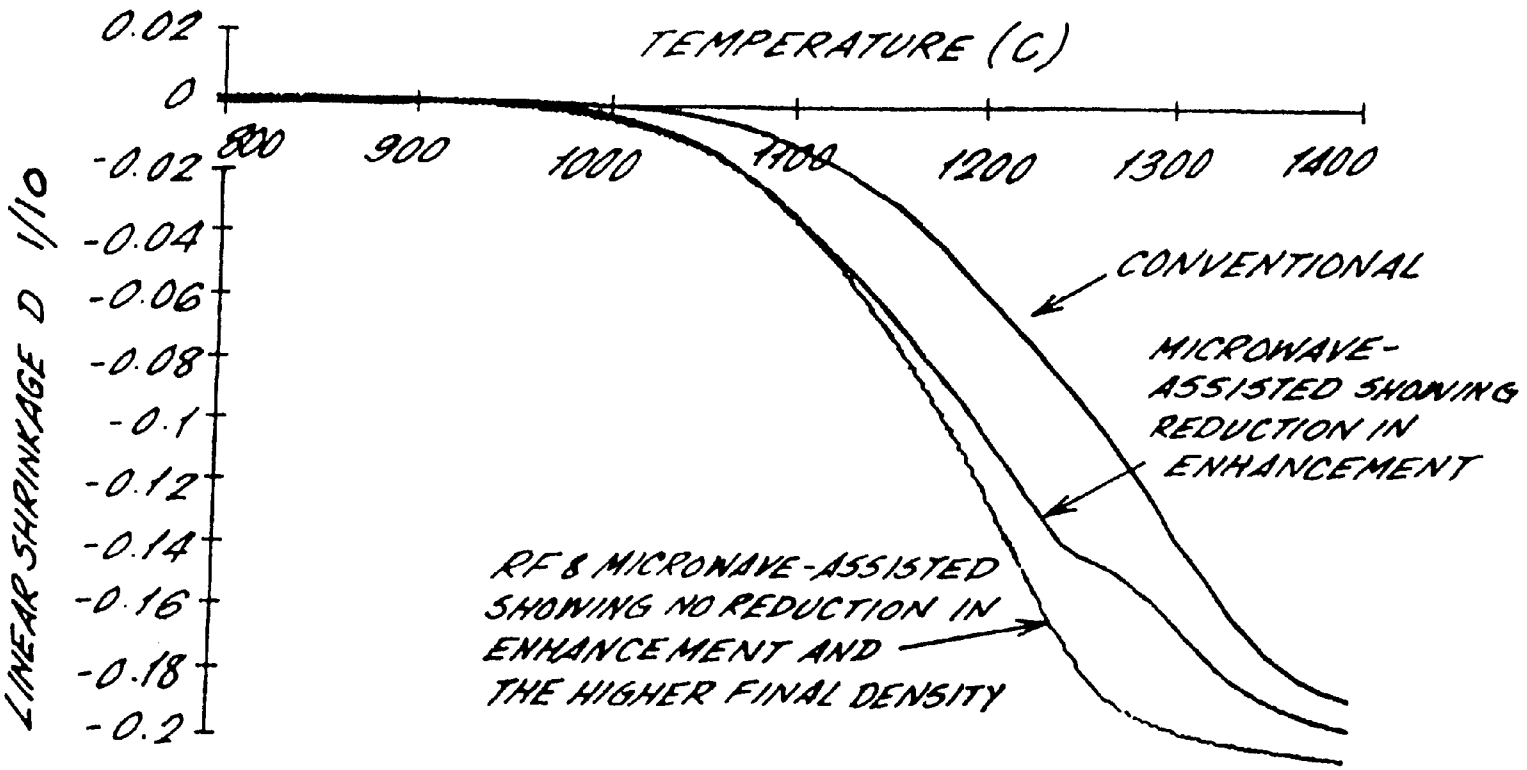
FIG. 11 is a graph illustrating the normalised linear shrinkage of zirconia (8 mol % yttria) plotted as a function of temperature for conventional (radiant heat only), microwave-assisted, and RF-microwave-assisted sintering.

These conclusions are illustrative graphically in FIG. 11 in which the normalised linear shrinkage of zirconia (8 mol % yttria) is plotted as a function of temperature for conventional sintering (using radiant heat only), microwave-assisted sintering and RF-microwave-assisted sintering. As can be seen, although the microwave-assisted sintering shows a reduction in enhancement similar to that illustrated in FIG. 8, no such reduction in enhancement can be detected in the RF-microwave-assisted sintering curve.

It will be apparent to those skilled in the art that although the above results relate to yttria stabilised zirconia, similar results have been shown to be applicable to a wide range of ceramic materials and is not limited to the particular material described above.

What is claimed is:

1. A hybrid furnace comprising a microwave source, an enclosure for the confinement of both microwave and RF energy and for containing an object to be heated, means for coupling the microwave source to said enclosure, an RF source adapted to dielectrically heat the object to be heated, means for coupling the RF source to said enclosure, and a controller for simultaneously applying both microwave energy and RF energy, and for controlling the quantity of microwave energy and RF energy to which the object to be heated is exposed.

2. A hybrid furnace in accordance with claim 1, wherein the controller controls the quantity of RF energy to which the object to be heated is exposed independently of the quantity of said microwave energy.

3. A hybrid furnace in accordance with claim 1 and additionally comprising at least one of radiant and convective heating means disposed in relation to said enclosure to provide at least one of radiant and convective heat as appropriate within the enclosure, the controller controlling the quantity of heat generated at a surface of the object to be heated by the said at least one of radiant and convective heat.

4. A hybrid furnace in accordance with claim 3, wherein the controller controls the quantity of heat generated at a surface of the object to be heated by the said at least one of radiant and convective heat independently of the heat generated in the object by said microwave energy.

5. A hybrid furnace in accordance with claim 3, wherein the controller controls the quantity of heat generated at a surface of the object to be heated by the said at least one of radiant and convective heat independently of the heat generated in the object by said RF energy.

6. A hybrid furnace in accordance with claim 3, wherein the said at least one of radiant and convective heating means comprises at least one resistive heating element.

7. A hybrid furnace in accordance with claim 3, wherein the said at least one of radiant and convective heating means comprises means for the burning of fossil fuels.

8. A method of operating a furnace of the type comprising a microwave source, an enclosure for the confinement of both microwave and RF energy and for containing an object to be heated, means for coupling the microwave source to said enclosure, an RF source adapted to dielectrically heat the object to be heated, and means for coupling the RF source to said enclosure, the method comprising the steps of actuating the microwave source to heat the object and actuating the RF source to provide an oscillating electric field within the object to be heated to dielectrically heat the object to be heated at at least one of a location and a temperature where the field strength of the microwave-induced electric field falls below a predetermined threshold value such that both microwave energy and RF energy are applied simultaneously.

9. A method of operating a furnace in accordance with claim 8, wherein the RF source is actuated throughout a heating cycle of the object.

10. A method of operating a furnace in accordance with claim 8 and comprising the additional step of controlling a quantity of RF energy to which the object to be heated is exposed independently of a quantity of microwave energy to which the object to be heated is exposed.

11. A method of operating a furnace in accordance with claim 8, wherein the furnace additionally comprises at least one of radiant and convective heating means and the method comprises the steps of actuating the additional heating means so as to generate at least one of radiant and convective heat substantially throughout a heating cycle of the object and controlling at least one of the quantity of heat generated in the object by the microwave energy and the quantity of heat generated at a surface of the object by the said at least one of the radiant and convective heat so as to provide a desired thermal profile in the object.

12. A method of operating a furnace in accordance with claim 11, wherein said additional heating means is actuated so as to generate sufficient heat to raise the temperature of the object to be heated to a predetermined value at which the object will be efficiently heated by the microwave energy and at which the microwave source is actuated.

13. A method of operating a furnace in accordance with claim 11, wherein the heat generated at a surface of the object to be heated by the said at least one of radiant and convective heat is controlled independently of the heat generated in the object by said microwave energy.

14. A method of operating a furnace in accordance with claim 11, wherein the heat generated at a surface of the object to be heated by the said at least one of radiant and convective heat is controlled independently of the heat generated in the object by said RF energy.

* * * * *